US007931008B2

(12) United States Patent
Verner et al.

(10) Patent No.: US 7,931,008 B2
(45) Date of Patent: Apr. 26, 2011

(54) SYSTEMS AND METHODS FOR DETECTING FAILED INJECTION EVENTS

(75) Inventors: Douglas R. Verner, Sterling Heights, MI (US); Craig D. Marriott, Clawson, MI (US); Kenneth J. Buslepp, Brighton, MI (US)

(73) Assignee: GM Global Technology Operations LLC

( * ) Notice: Subject to any disclaimer, the term of this patent is extended or adjusted under 35 U.S.C. 154(b) by 0 days.

(21) Appl. No.: 12/534,345

(22) Filed: Aug. 3, 2009

(65) Prior Publication Data

US 2011/0023836 A1 Feb. 3, 2011

(51) Int. Cl.
*F02M 51/00* (2006.01)

(52) U.S. Cl. ..... 123/479; 123/490

(58) Field of Classification Search ..... 123/490, 123/472, 478, 479, 482; 239/585.1; 73/114.45, 73/114.47, 114.49
See application file for complete search history.

(56) References Cited

U.S. PATENT DOCUMENTS 5,245,501 A * 9/1993 Locher et al. ..... 361/154
5,986,871 A * 11/1999 Forck et al. ..... 361/160
6,880,530 B2 * 4/2005 Oyama et al. ..... 123/479
7,054,772 B2 * 5/2006 Iannone et al. ..... 702/65

* cited by examiner

*Primary Examiner* — Hai H Huynh

(57) ABSTRACT

A fuel injection system includes an injector control module, a current detection module, and a position determination module. The injector control module controls current through a solenoid of a fuel injector for a predetermined period. The current detection module measures an amount of current through the solenoid after the predetermined period. The position determination module determines whether the fuel injector injected fuel during the predetermined period based on when the amount of current through the solenoid is less than or equal to a predetermined current.

20 Claims, 11 Drawing Sheets

SYSTEMS AND METHODS FOR DETECTING FAILED INJECTION EVENTS

FIELD

The present disclosure relates to fuel injection systems and more particularly to determining a position of a fuel injector needle.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel injection system injects fuel into an engine using fuel injectors. An engine control module (ECM) may actuate fuel injectors using a voltage/current pulse. The ECM may control a width of the pulse to control an amount of fuel injected into the engine. The ECM may apply pulses of varying widths to control combustion in the engine. Additionally, the ECM may apply pulses of varying widths to control a temperature and composition of exhaust gas to aid in control of emissions. The fuel injector may fail to inject fuel when a pulse is applied. The ECM may determine when the fuel injector failed to inject fuel based on a deceleration of the engine.

SUMMARY

A fuel injection system comprises an injector control module, a current detection module, and a position determination module. The injector control module controls current through a solenoid of a fuel injector for a predetermined period. The current detection module measures an amount of current through the solenoid after the predetermined period. The position determination module determines whether the fuel injector injected fuel during the predetermined period based on when the amount of current through the solenoid is less than or equal to a predetermined current.

A method comprises controlling current through a solenoid of a fuel injector for a predetermined period. The method further comprises measuring an amount of current through the solenoid after the predetermined period. Additionally, the method comprises determining whether the fuel injector injected fuel during the predetermined period based on when the amount of current through the solenoid is less than or equal to a predetermined current.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
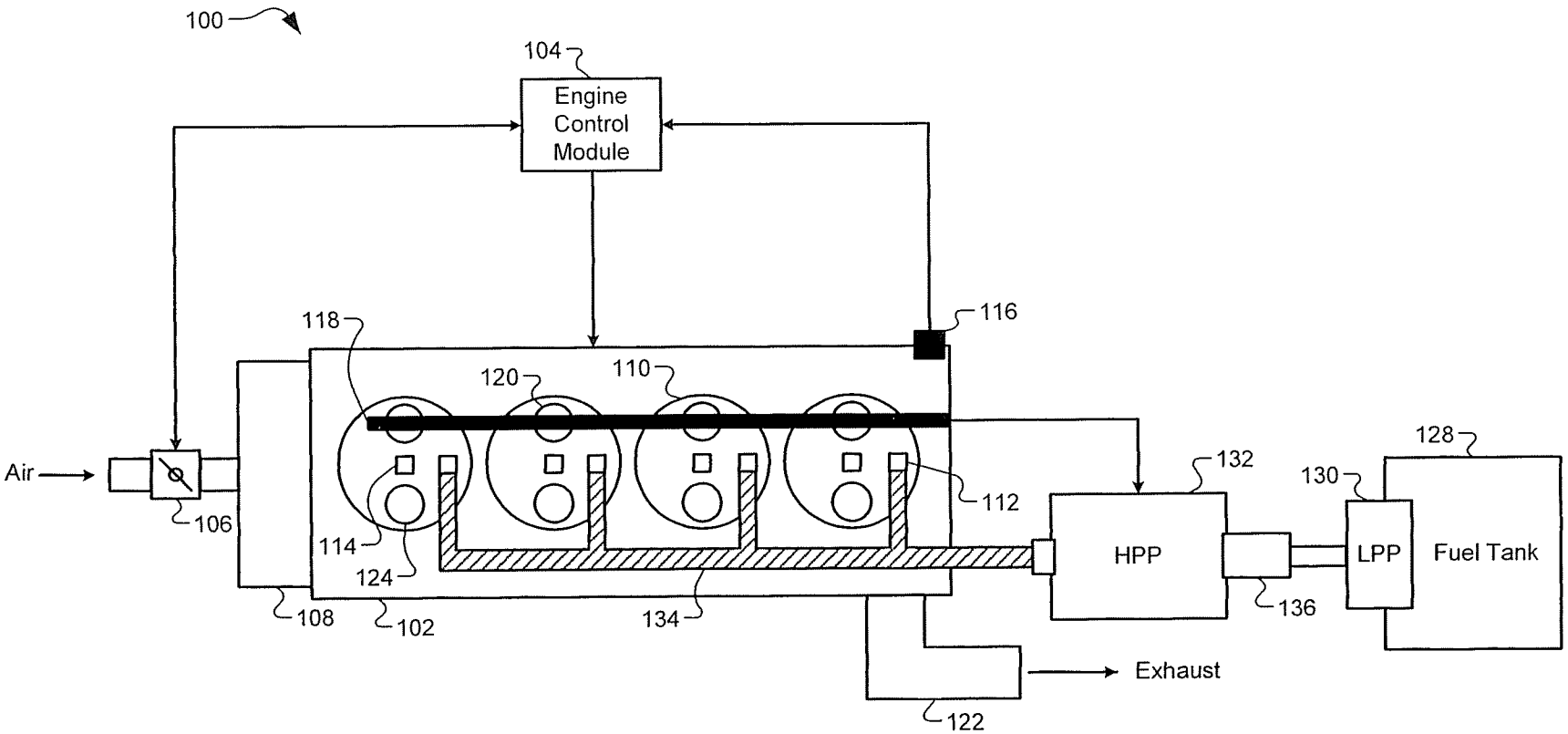
FIG. 1 is a functional block diagram of an engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

Typically, an engine control module (ECM) may detect an injection of fuel (hereinafter "injection event") into an engine based on acceleration of the engine. However, the ECM may not detect an injection event (i.e., a singular injection even) when a pulse applied to a fuel injector is sufficiently short (e.g., the amount of fuel injected is small). Accordingly, the ECM may not detect a failed injection event corresponding to a sufficiently short pulse.

An injection detection system according to the present disclosure detects a failed injection event (i.e., a singular failed injection event) corresponding to a short pulse based on an amount of current through a solenoid of the fuel injector after the failed injection event. The injection detection system may detect the failed injection event based on a length of time during which the solenoid discharges after the failed injection event. Additionally, the injection detection system may determine an amount of fuel injected during the short pulse based on the length of time.

Referring now to FIG. 1, an exemplary engine system 100 includes a combustion engine 102. While a spark ignition direct injection engine is illustrated, port fuel injection engines and compression ignition engines are also contemplated. An engine control module (ECM) 104 communicates with components of the engine system 100. The components may include the engine 102, sensors, and actuators as discussed herein. The ECM 104 may implement the injection detection system of the present disclosure.

The ECM 104 may actuate a throttle 106 to regulate airflow into an intake manifold 108. Air within the intake manifold 108 is distributed into cylinders 110. The ECM 104 actuates fuel injectors 112 to inject fuel into the cylinders 110. The ECM 104 may actuate spark plugs 114 to ignite an air/fuel mixture in the cylinders 110. Alternatively, the air/fuel mixture may be ignited by compression in a compression ignition engine. Compression ignition engines may include diesel engines and homogeneous charge compression ignition (HCCI) engines. While four cylinders 110 of the engine 102 are shown, the engine 102 may include more or less than four cylinders.

An engine crankshaft (not shown) rotates at engine speed or a rate that is proportional to the engine speed. For example only, the crankshaft sensor 116 may include at least one of a variable reluctance and a Hall-effect sensor. The ECM 104 may determine the position of the crankshaft during engine operation based signals from the crankshaft sensor 116.

The ECM 104 may determine a position of a piston (not shown) based on the position of the crankshaft. For example, the ECM 104 may determine that the piston is at top dead center (TDC) based on the position of the crankshaft. The ECM 104 may actuate the fuel injectors 112 and the spark plugs 114 based on the position of the piston.

An intake camshaft 118 regulates a position of an intake valve 120 to enable air to enter the cylinder 110. Combustion exhaust within the cylinder 110 is forced out through an exhaust manifold 122 when an exhaust valve 124 is in an open position. An exhaust camshaft (not shown) regulates a position of the exhaust valve 124. Although single intake and exhaust valves 120, 124 are illustrated, the engine 102 may include multiple intake and exhaust valves 120, 124 per cylinder 110.

A fuel system supplies fuel to the engine 102. The fuel system may include a fuel tank 128, a low-pressure pump (LPP) 130, a high-pressure pump (HPP) 132, a fuel rail 134, and the fuel injectors 112. Fuel is stored in the fuel tank 128. The LPP 130 pumps fuel from the fuel tank 128 and provides fuel to the HPP 132. The HPP 132 pressurizes fuel for delivery to the fuel injectors 112 via the fuel rail 134. The ECM 104 actuates a control valve 136 to regulate fuel provided from the LPP 130 to the HPP 132.

Figure 2A:
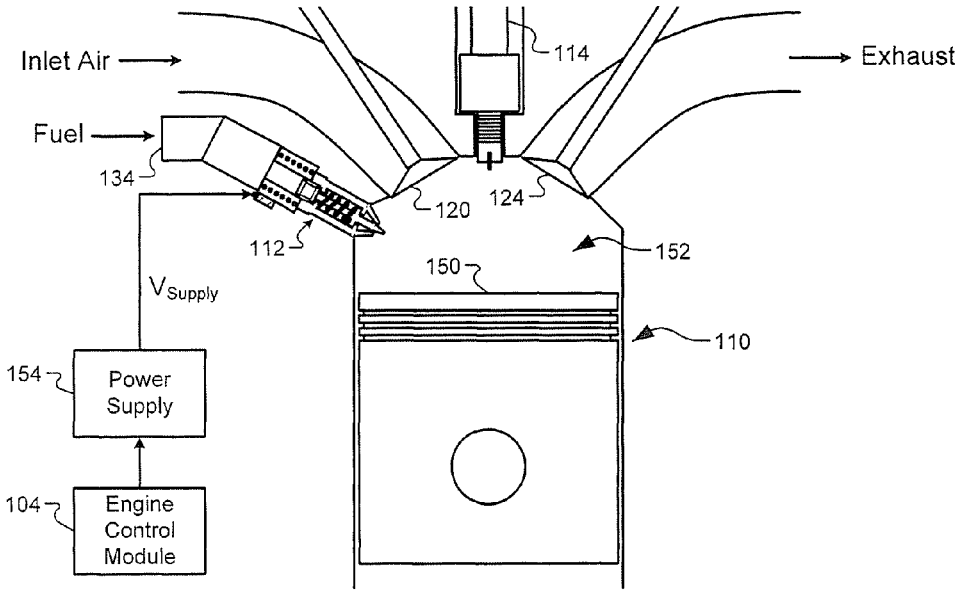
FIG. 2A is a cross-sectional diagram of a cylinder of the engine system according to the present disclosure.

Referring now to FIG. 2A, a cross-sectional view of the cylinder 110 is shown. The cylinder 110 includes a piston 150. The fuel injector 112 and the spark plug 114 may be connected to the cylinder 110. The intake valve 120 regulates an amount inlet air drawn into a combustion chamber 152. The ECM 104 may actuate the fuel injector 112 to inject fuel into the combustion chamber 152. The ECM 104 may actuate the fuel injector 112 via a power supply 154. The power supply 154 may provide power to the fuel injector 112 to actuate the fuel injector 112. Accordingly, the ECM 104 may control the power supply 154 to provide the power to the fuel injector 112. The spark plug 114 may ignite the fuel in the combustion chamber 152. The exhaust valve 124 may open to allow exhaust gas to leave the combustion chamber 152. While the cylinder 110 is shown to include the fuel injector 112, the fuel injector 112 may inject fuel outside of the cylinder 110 (i.e. port fuel injection).

Figure 2B:
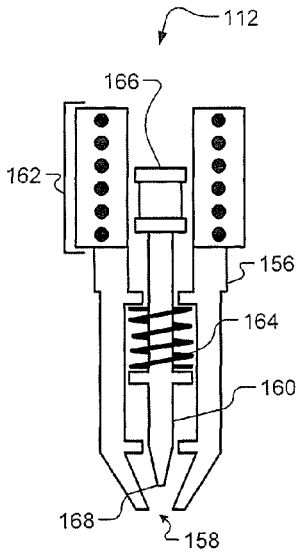
FIG. 2B is a cross-sectional diagram of a fuel injector having a needle in an open position.
Figure 2C:
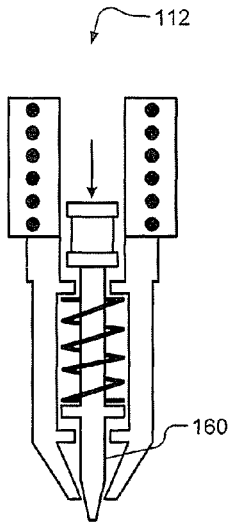
FIG. 2C is a cross-sectional diagram of the fuel injector having a needle transitioning from the open position to a closed position.
Figure 2D:
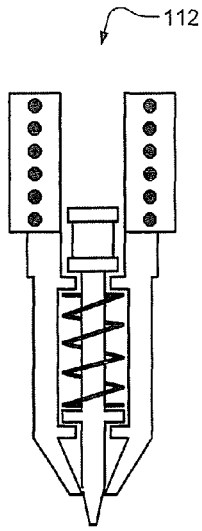
FIG. 2D is a cross-sectional diagram of the fuel injector having a needle in the closed position.

Referring now to FIGS. 2B-2D, the fuel injector 112 may include a fuel injector housing 156, an outlet 158, a needle 160, a solenoid 162, and a spring 164. The fuel injector 112 may be connected to the engine 102 via the housing 156. The ECM 104 may apply power to the solenoid 162 to generate a magnetic field in the core of the solenoid 162. Applying power to the solenoid 162 may be referred to hereinafter as "activating the fuel injector 112." Accordingly, the ECM 104 may activate the fuel injector 112 to generate a magnetic field in the core of the solenoid 112. Reducing power to the solenoid 112 may be referred to hereinafter as "deactivating the fuel injector 112." For example, the power supply 154 may supply zero power to the fuel injector 112 when the fuel injector 112 is deactivated. Accordingly, the magnetic field in the solenoid 162 will collapse when the ECM 104 deactivates the fuel injector 112.

The needle 160 may include a needle head 166 and a needle tip 168. The needle head 166 may be positioned proximate to the solenoid 162 when the fuel injector 112 is deactivated. The ECM 104 may activate the fuel injector 112 to draw the needle head 166 into the solenoid 162. Accordingly, the ECM 104 may activate the fuel injector 112 to draw the needle tip 168 into the injector housing 156. The outlet 158 of the fuel injector 112 may be open when the needle tip 168 is drawn into the injector housing 156. Hereinafter, the needle 160 may be referred to as being in an open position when the ECM 104 activates the fuel injector 112. The needle 160 of FIG. 2B is in the open position. Fuel may flow through the outlet 158 and into the combustion chamber 152 when the needle 160 is in the open position.

While the fuel injector 112 is illustrated and described as injecting fuel when the needle 160 is drawn into the injector housing 156, alternative injectors may inject fuel using a needle that protrudes from the housing. The injection detection system may be implemented using fuel injectors that inject fuel when the needle protrudes from the housing.

The spring 164 may force the needle 160 into a closed position when the ECM 104 deactivates the fuel injector 112. Accordingly, the needle 160 may transition from the open position to the closed position when the fuel injector 112 is deactivated. FIG. 2C illustrates a transition of the needle 160 from the open position to the closed position. The needle 160 may be in the closed position a period of time after deactivation of the fuel injector 112. Fuel may not flow through the outlet 158 and into the combustion chamber 152 when the needle 160 is in the closed position. FIG. 2D illustrates the needle 160 in the closed position.

The ECM 104 may apply power (e.g., a pulse) to activate the fuel injector 112 over a period of time (hereinafter "pulse period"). Fuel may flow through the outlet 158 and into the combustion chamber 152 during the pulse period. The ECM 104 may change a length of the pulse period to control an amount of fuel injected into the combustion chamber 152. The ECM 104 may increase the length of the pulse period to increase the amount of fuel injected into the combustion chamber 152. The ECM 104 may decrease the length of the pulse period to decrease the amount of fuel injected into the combustion chamber 152.

The pulse used to activate the fuel injector 112 may be described as a primary pulse or a secondary pulse. The primary pulse may have a relatively longer pulse period than the secondary pulse. For example only, a primary pulse may draw the needle head 166 into the solenoid 162 until the needle head 166 reaches a stable position that yields a constant flow rate.

The secondary pulse may be a pulse having a relatively short pulse period. For example only, the secondary pulse may have a pulse period of less than 500 μs. The secondary pulse may also refer to a pulse applied after the primary pulse. In some implementations, one or more secondary pulses may be applied after a primary pulse within one cylinder cycle (i.e., split injection). For example, the secondary pulse may be applied to provide a fraction of the fuel of the primary pulse (e.g., 40% of the primary pulse) after the primary pulse is applied.

The secondary pulse may draw the needle head 166 into the solenoid 162 a shorter distance than the primary pulse because of the shortened pulse period. A relationship between a quantity of fuel injected and pulse duration may be nonlinear when the pulse is a secondary pulse. A relationship between a quantity of fuel injected and pulse duration may be linear when the pulse is a primary pulse. The ECM 104 may apply the secondary pulse to inject a reduced amount of fuel. For example, the ECM 104 may apply a primary pulse followed by secondary pulses to control combustion processes in the engine 102. Additionally, the ECM 104 may apply the secondary pulses to control a temperature and composition of exhaust gas to aid in control of emissions.

The fuel injector 112 may fail to inject fuel when the ECM 104 activates the fuel injector 112 for the pulse period. A failure to inject fuel in response to a pulse from the ECM 104 may be referred to hereinafter as a "failed injection event." The ECM 104 may detect a failed injection event when the ECM 104 applies a primary pulse. Ignition of the primary pulse in the combustion chamber 152 may cause an increase in engine speed. Accordingly, the ECM 104 may detect the failed injection of the primary pulse based on signals from the crankshaft sensor 116. For example, when the ECM 104 commands the primary pulse and the fuel injector 112 fails to inject fuel in response to the primary pulse, the ECM 104 may detect a deceleration of the engine 102 based on signals from the crankshaft sensor 116.

Ignition of a secondary pulse may not be detected based on acceleration of the engine 102 since ignition of the secondary pulse may not increase engine acceleration significantly. The ECM 104 may therefore not detect a failed injection of a secondary pulse. The injection detection system of the present disclosure may determine when there is a failed injection of a secondary pulse based on the amount of current through the solenoid 162 after the fuel injector 112 is deactivated. For example, the injection detection system may determine when there is a failed injection of a secondary pulse based on an amount of time corresponding to a predetermined change in the amount of current through the solenoid 162.

Figure 3:
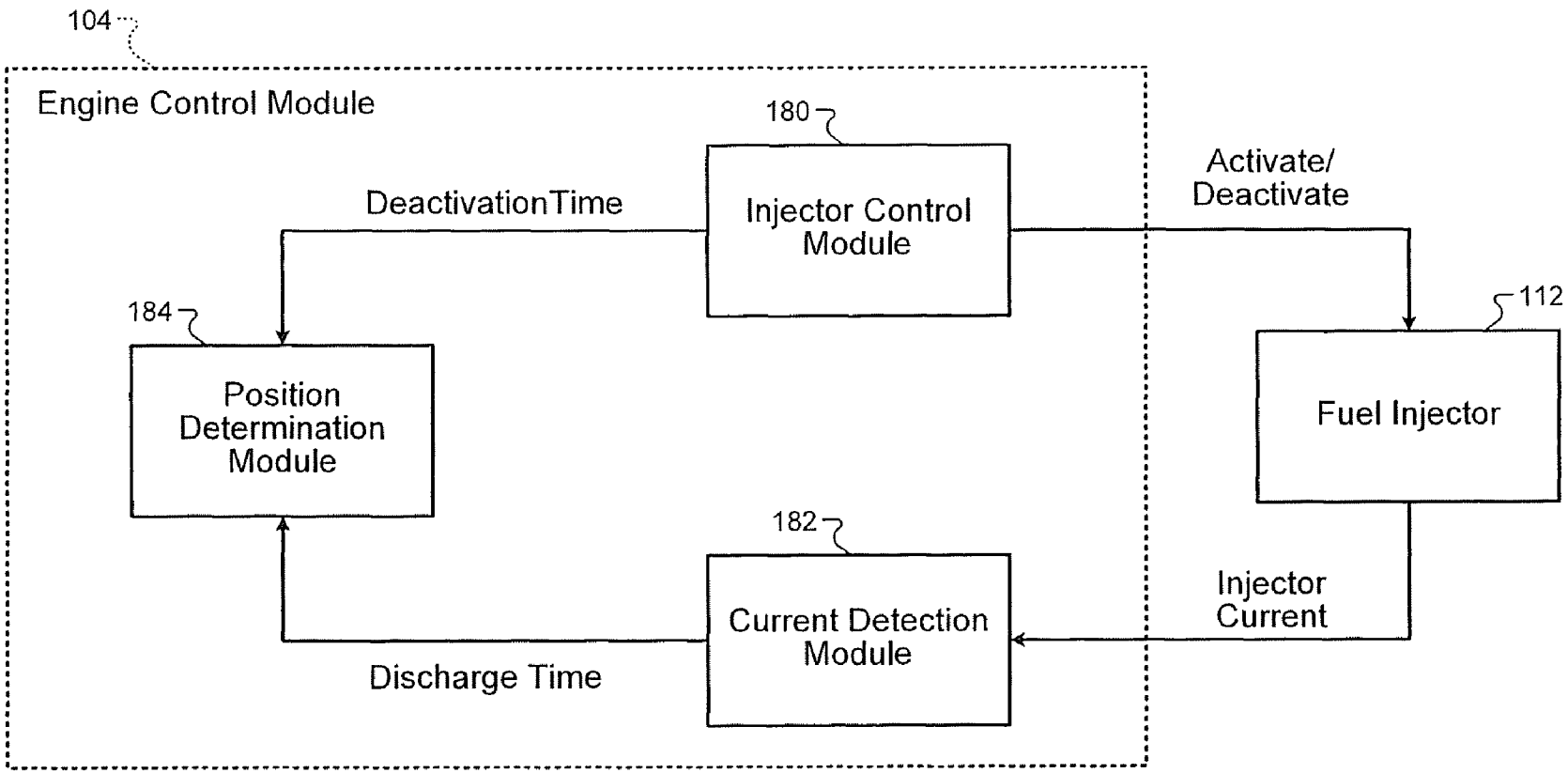
FIG. 3 is a functional block diagram of an engine control module according to the present disclosure.

Referring now to FIG. 3, the ECM 104 includes an injector control module 180, a current detection module 182, and a position determination module 184. The injector control module 180 may selectively activate and deactivate the fuel injector 112. The current detection module 182 may measure the amount current through to the solenoid 162 after the injector control module 180 deactivates the fuel injector 112. The position determination module 184 may determine the position of the needle 160 at the time the fuel injector 112 was deactivated based on a change in the amount of current through the solenoid 162 during a period of time after the fuel injector 112 is deactivated.

The injector control module 180 may activate the injector 112 for the pulse period. The injector control module 180 may deactivate the fuel injector 112 at an end of the pulse period. The injector control module 180 may store a time that corresponds to when the injector control module 180 deactivates the fuel injector 112. The time that corresponds to when the injector control module 180 deactivates the fuel injector 112 may be referred to hereinafter as a "deactivation time."

The current detection module 182 may measure the amount of current through the solenoid 162 of the fuel injector 112 after the deactivation time. The current detection module 182 may detect when the amount of current through the solenoid 162 is less than or equal to a lower threshold. The current detection module 182 may store a lower threshold time that corresponds to when the amount of current through the solenoid 162 is less than or equal to the lower threshold. For example only, the lower threshold may include a current of zero amperes. Accordingly, the current detection module 182 may store the lower threshold time when the current through the solenoid 162 is equal to zero amperes.

The current detection module 182 may detect when the amount of current through the solenoid 162 is less than or equal to an upper threshold. The current detection module 182 may store an upper threshold time that corresponds to when the amount of current through the solenoid 162 is less than or equal to the upper threshold. For example only, the upper threshold may include an amount of current equal to the amount of current through the solenoid 162 when the solenoid 162 is activated. Accordingly, the current detection module 182 may set the upper threshold time equal to the deactivation time. The solenoid 162 may discharge from the upper threshold current to the lower threshold current during the period between the upper threshold time and the lower threshold time. The period between the upper threshold time and the lower threshold time may be referred to hereinafter as a "discharge time." The current detection module 182 may determine the discharge time based on the upper threshold time and the lower threshold time. For example, the current detection module 182 may determine the discharge time based on a difference between the upper threshold time and the lower threshold time.

The position determination module 184 may determine the position of the needle 160 at the time the fuel injector 112 was deactivated based on the discharge time. For example, the position determination module 184 may determine whether the needle 160 was in the open position or the closed position prior to deactivation. Accordingly, the position determination module 184 may determine whether fuel was injected or there was a failed injection event when the fuel injector 112 was activated. In some implementations, the position determination module 184 may determine that a failed injection event occurred when the discharge time is greater than a predetermined threshold.

The predetermined threshold may depend on various factors related to the electrical and mechanical properties of the fuel injector 112. Electrical properties of the fuel injector 112 may include, but are not limited to, an inductance and/or reluctance of the solenoid 162. Mechanical properties of the fuel injector 112 may include, but are not limited to, an operating pressure of the fuel injector 112, a tension of the spring 164, a size of the needle 160, and a material composition of the needle 160 and the needle head 166.

Mechanical properties of the fuel injector 112 may also affect electrical properties of the fuel injector 112. For example, the material composition of the needle 160 and the needle head 166 may affect the inductance and the reluctance of the solenoid 162 when the needle head 166 is drawn into the solenoid 162. The reluctance may be a function of the distance the needle head 166 is drawn into the solenoid 162 (i.e., an air gap in the solenoid 166) and the inductance. The inductance of the solenoid 162 may depend on the pulse period, since the distance the needle head 166 is drawn into the solenoid 162 may depend on the pulse period. For example, a longer pulse may draw the needle head 166 farther into the solenoid 162 than a shorter pulse. In summary, the predetermined threshold may be a value calculated based on mechanical and electrical properties of the fuel injector 112. In some implementations, the mechanical and electrical properties of the fuel injector 112 may be determined based on deactivation current behavior corresponding to primary pulses when crankshaft detection can be used to verify normal operation.

Figure 4B:
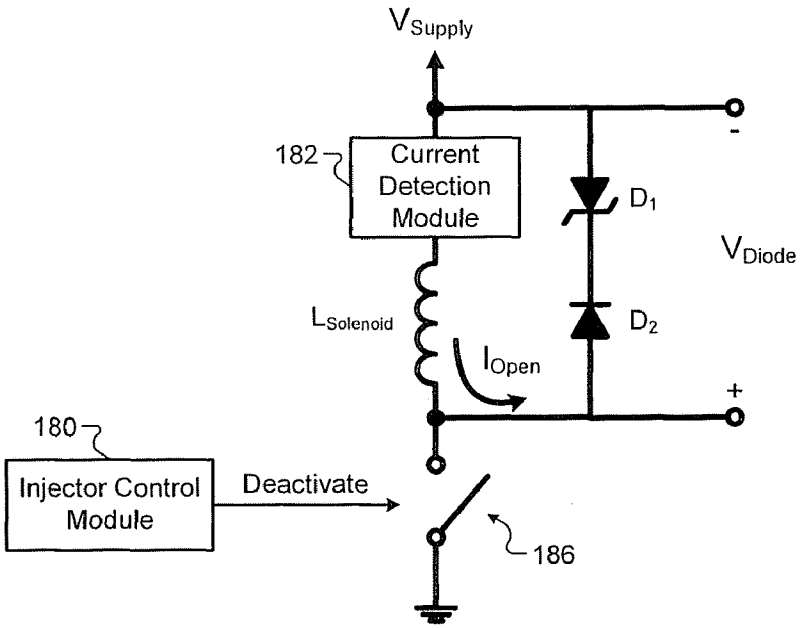
FIG. 4B illustrates communication between the engine control module and the fuel injector when the needle in the open position according to the present disclosure.
Figure 4A:
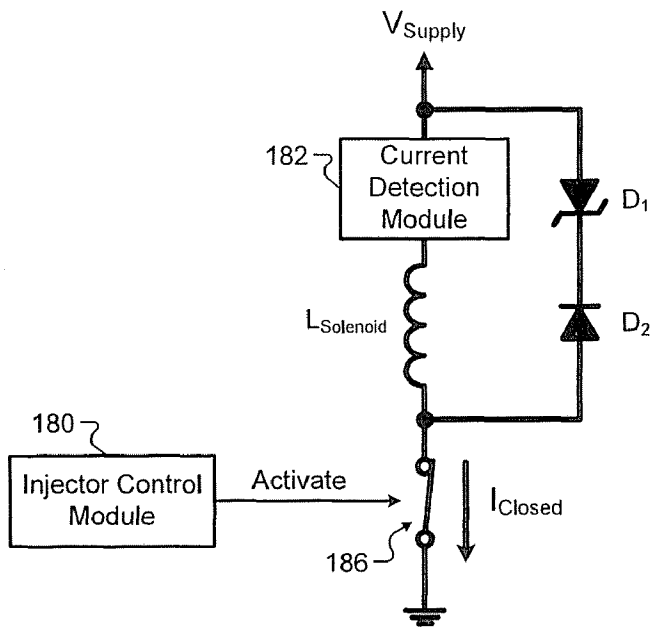
FIG. 4A illustrates communication between the engine control module and the fuel injector when the needle is in the closed position according to the present disclosure.

Referring now to FIG. 4A, an exemplary schematic illustrates electrical operation of the injection detection system. The inductor ($L_{Solenoid}$) may represent the solenoid 162. The injector control module 180 may close a switch 186 to connect the solenoid 162 to ground. The power supply 154 ($V_{Supply}$) may apply power to the solenoid 162 when the switch 186 connects the solenoid 162 to ground. Current may flow through the current detection module 182 and the solenoid 162 when the solenoid 162 is connected to ground. Accordingly, the needle 160 may be in the open position when the switch 186 is closed. The current detection module 182 of FIG. 4A may provide a low resistance path for current that does not affect operation of other system components (e.g., the solenoid 162).

Referring now to FIG. 4B, the injector control module 180 may open the switch 186 to deactivate the injector 112. A voltage may develop across the solenoid 162 when the switch 186 opens. The diodes $D_1$ and $D_2$ may regulate the voltage that develops across the solenoid 162. A time varying current ($I_{Open}$) may flow through the diodes when the voltage reaches a magnitude $V_{Diode}$. The current $I_{Open}$ may decay over time. The rate of change of $I_{Open}$ may be proportional to the voltage across the diodes. $I_{Open}$ may decay to zero after the switch 186 has been open for a period of time. The current detection module 182 of FIG. 4B may provide a low resistance path for current that does not affect operation of other system components.

The position determination module 184 may determine the position of the needle 160 at the deactivation time based on the amount of time from when $I_{Open}$ is less than or equal to the upper threshold until $I_{Open}$ is less than or equal to the lower threshold. For example, the position determination module 184 may determine the position of the needle 160 at the deactivation time based on a length of a period from deactivation time until $I_{Open}$ is equal to zero amperes.

Figure 5:
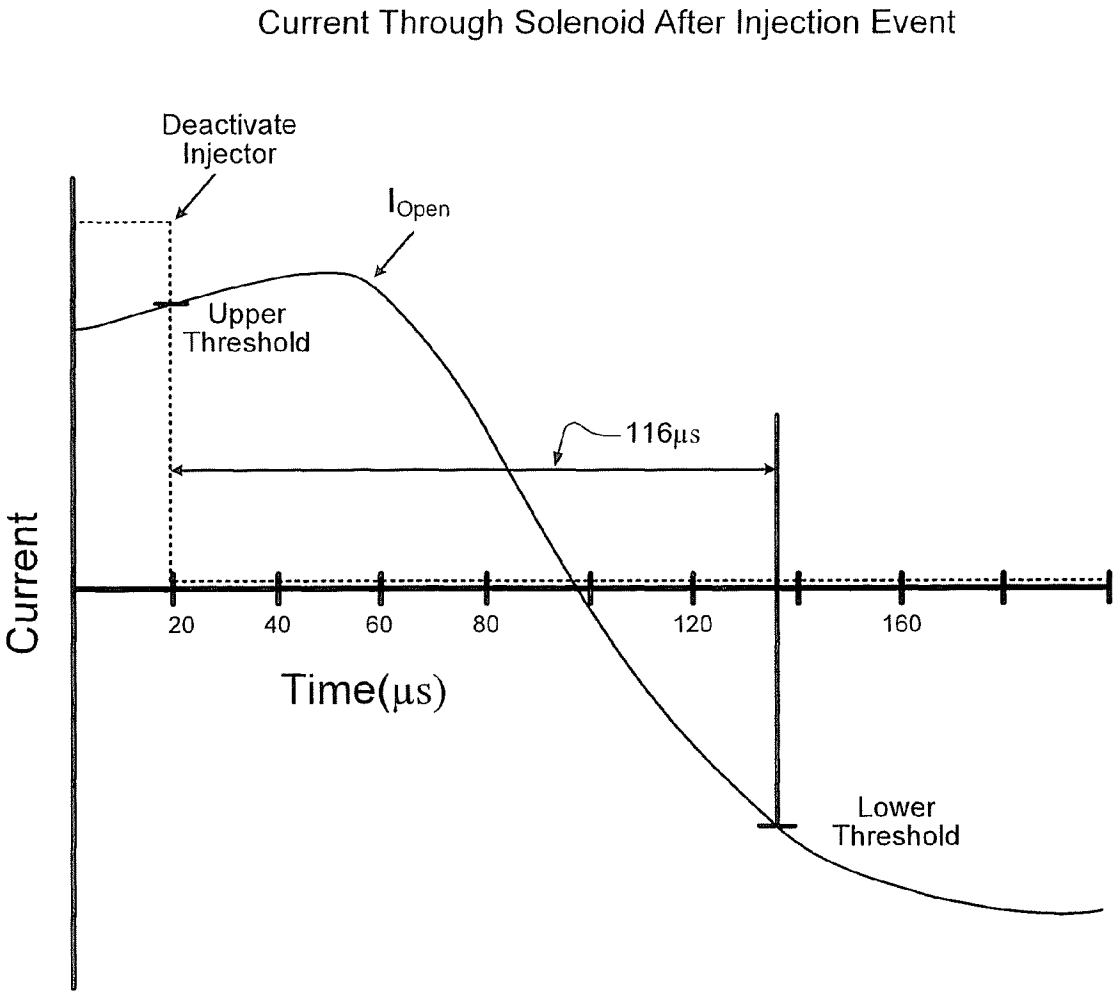
FIG. 5 illustrates a time period between deactivation of the fuel injector and detection of a lower threshold current after an injection event according to the present disclosure.
Figure 6:
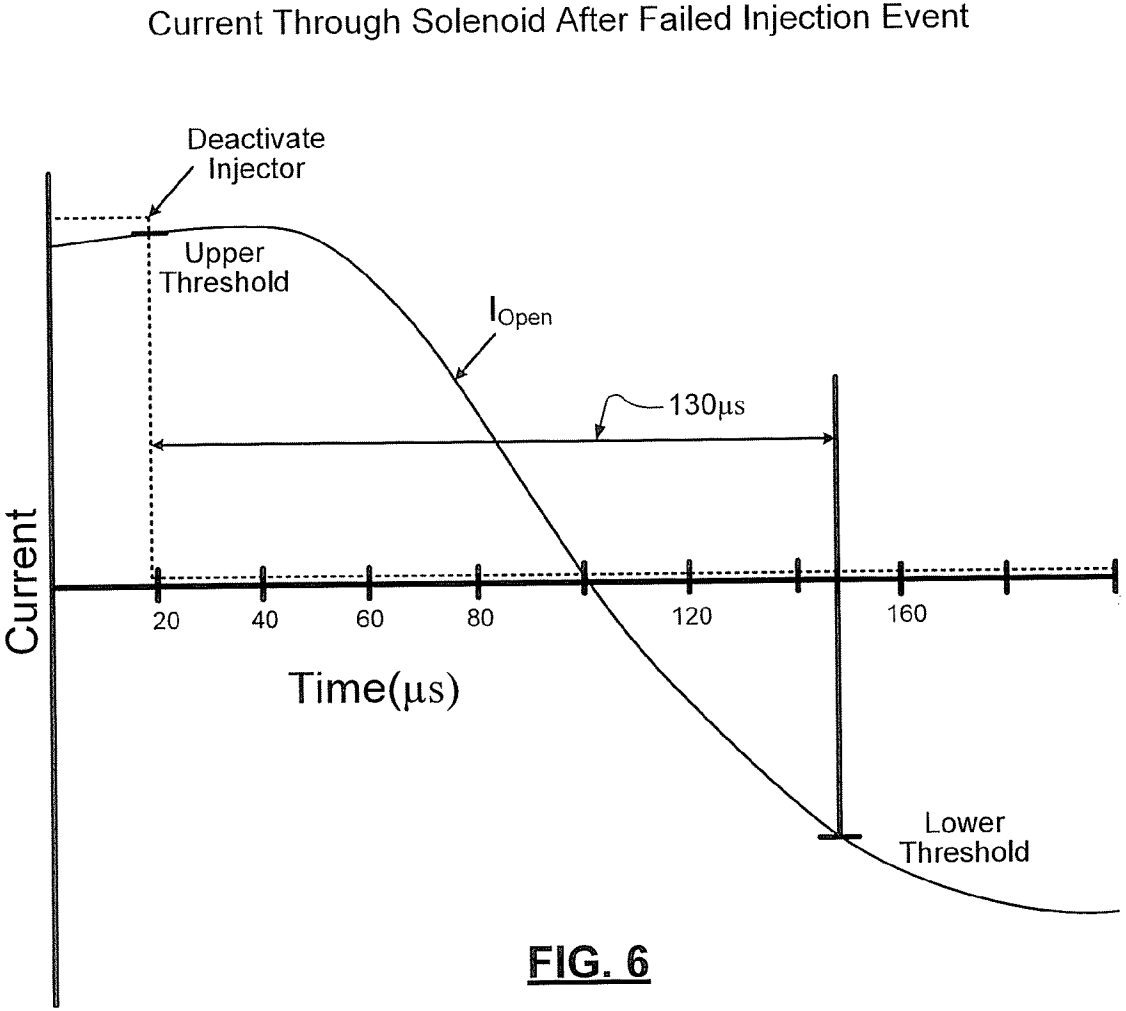
FIG. 6 illustrates a time period between deactivation of the fuel injector and detection of the lower threshold current after a failed injection event according to the present disclosure.

Referring now to FIGS. 5-6, $I_{Open}$ is illustrated for an exemplary fuel injector 112. The dotted line of FIGS. 5-6 illustrates when the fuel injector 112 is deactivated. FIG. 5 illustrates $I_{Open}$ for a fuel injector 112 that injects fuel in response to a pulse from the ECM 104. FIG. 6 illustrates $I_{Open}$ following a failed injection event. In FIGS. 5-6, the discharge time is measured from the deactivation time until the amount of current through the solenoid 162 is less than or equal to the lower threshold. The discharge time of FIG. 5 is 116 μs. The discharge time of FIG. 6 is 130 μs. Accordingly, the discharge time of the exemplary fuel injector 112 may be greater when an injection event fails.

For example only, when the exemplary fuel injector 112 of FIGS. 5-6 is used in the injection detection system, the predetermined threshold may be set to a value greater than 116 μs. Accordingly, when the injection detection system uses the exemplary fuel injector 112 of FIGS. 5-6, the injection detection system may determine that a failed injection event occurred when the injection detection system determines that the discharge time is greater than 116 μs.

Figure 7:
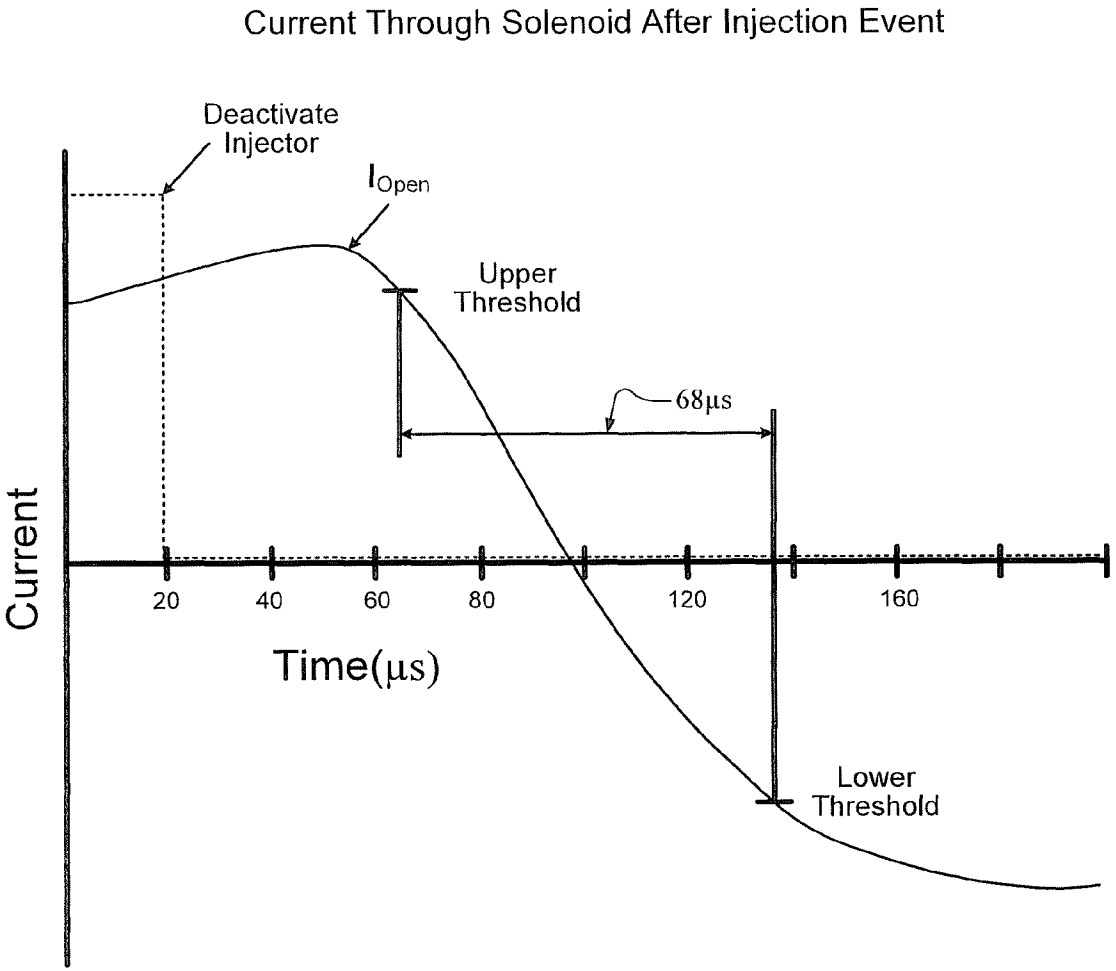
FIG. 7 illustrates a time period between an upper threshold current and the lower threshold current after an injection event according to the present disclosure.
Figure 8:
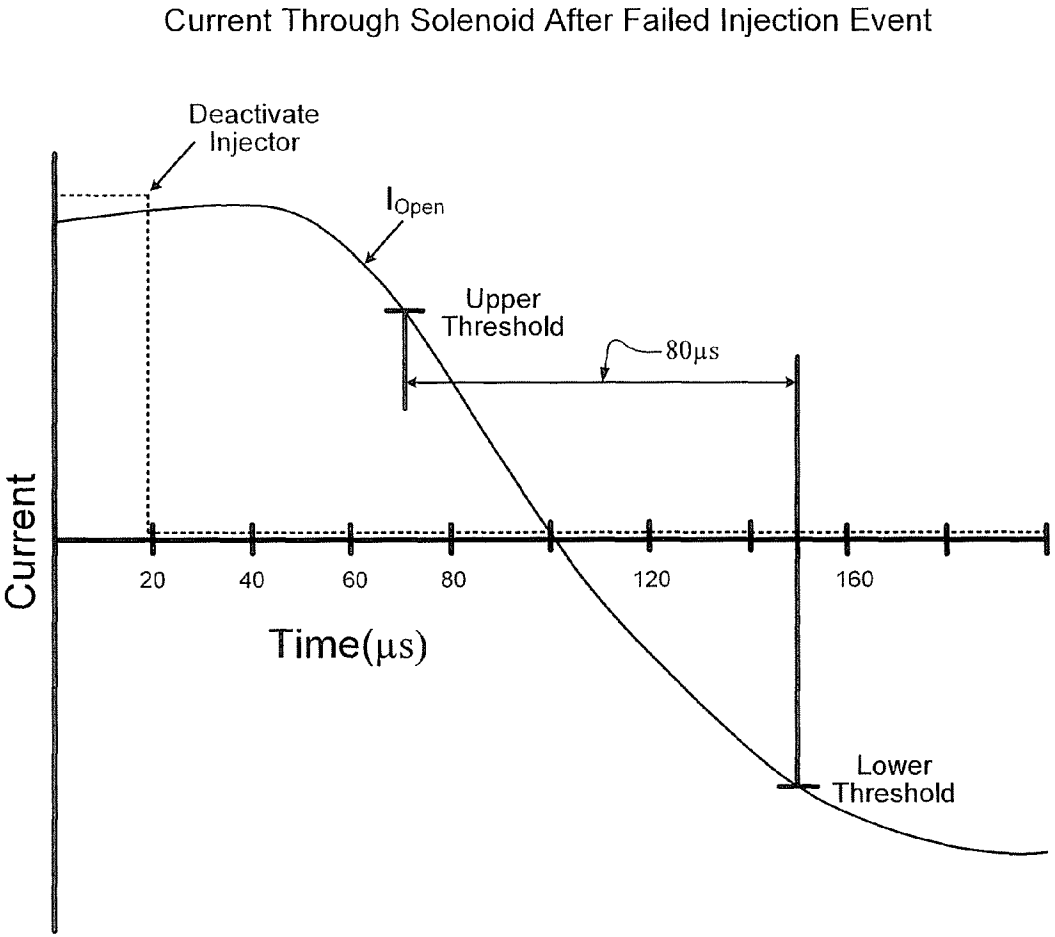
FIG. 8 illustrates a time period between the upper threshold current and the lower threshold current after a failed injection event according to the present disclosure.

Referring now to FIGS. 7-8, $I_{Open}$ is illustrated for the exemplary fuel injector 112. FIG. 7 illustrates $I_{Open}$ for a fuel injector 112 that injects fuel in response to a pulse from the ECM 104. FIG. 8 illustrates $I_{Open}$ following a failed injection event. In FIGS. 7-8, the discharge time is measured from when $I_{Open}$ is less than or equal to the upper threshold until $I_{Open}$ is less than or equal to the lower threshold. The discharge time of FIG. 7 is 68 μs. The discharge time of FIG. 8 is 80 μs. Accordingly, the discharge time of the exemplary fuel injector 112 may be greater when an injection event fails.

For example only, when the exemplary fuel injector 112 of FIGS. 7-8 is used in the injection detection system, the predetermined threshold may be set to a value greater than 68 μs. Accordingly, when the injection detection system uses the exemplary fuel injector 112 of FIGS. 7-8, the injection detection system may determine that a failed injection event occurred when the discharge time is greater than 68 μs.

While the discharge time for a failed injection event is described as longer than the discharge time for a successful injection event, in some implementations, a successful injection event may have a longer discharge time than a failed injection event. Accordingly, the discharge time corresponding to a failed injection event and a successful injection event may depend on the mechanical and electrical properties of a particular fuel injector.

The injection detection system of the present disclosure may also determine a distance the needle head 166 and the needle 160 are drawn into the solenoid 162 based on the discharge time. Accordingly, the injection detection system may determine the amount of fuel injected into the combustion chamber 152 based on the discharge time. In other words, the injection detection system may determine the amount of fuel injected into the combustion chamber 152 independent of the pulse period during which the fuel injector 112 is actuated.

The position determination module 184 may determine the distance the needle head 166 is drawn into the solenoid 162 and a corresponding amount of fuel injected into the combustion chamber 152 based on the discharge time. FIGS. 5-6 illustrate that the discharge time may be greater for a failed injection event (130 μs) than a successful injection event (116 μs). A discharge time of 130 μs may correspond to an injection of no fuel. A discharge time of 116 μs may correspond to an injection of a first amount of fuel. Accordingly, a discharge time between 130 μs and 116 μs may correspond to an injection of an amount of fuel between zero and the first amount, respectively. For example only, if the current detection module 182 determines that the discharge time is 122 μs, the position determination module 184 may determine that the amount of fuel injected is greater than the amount injected for a 130 μs discharge time and less than the amount of fuel injected for the 116 μs discharge time.

Figure 9:
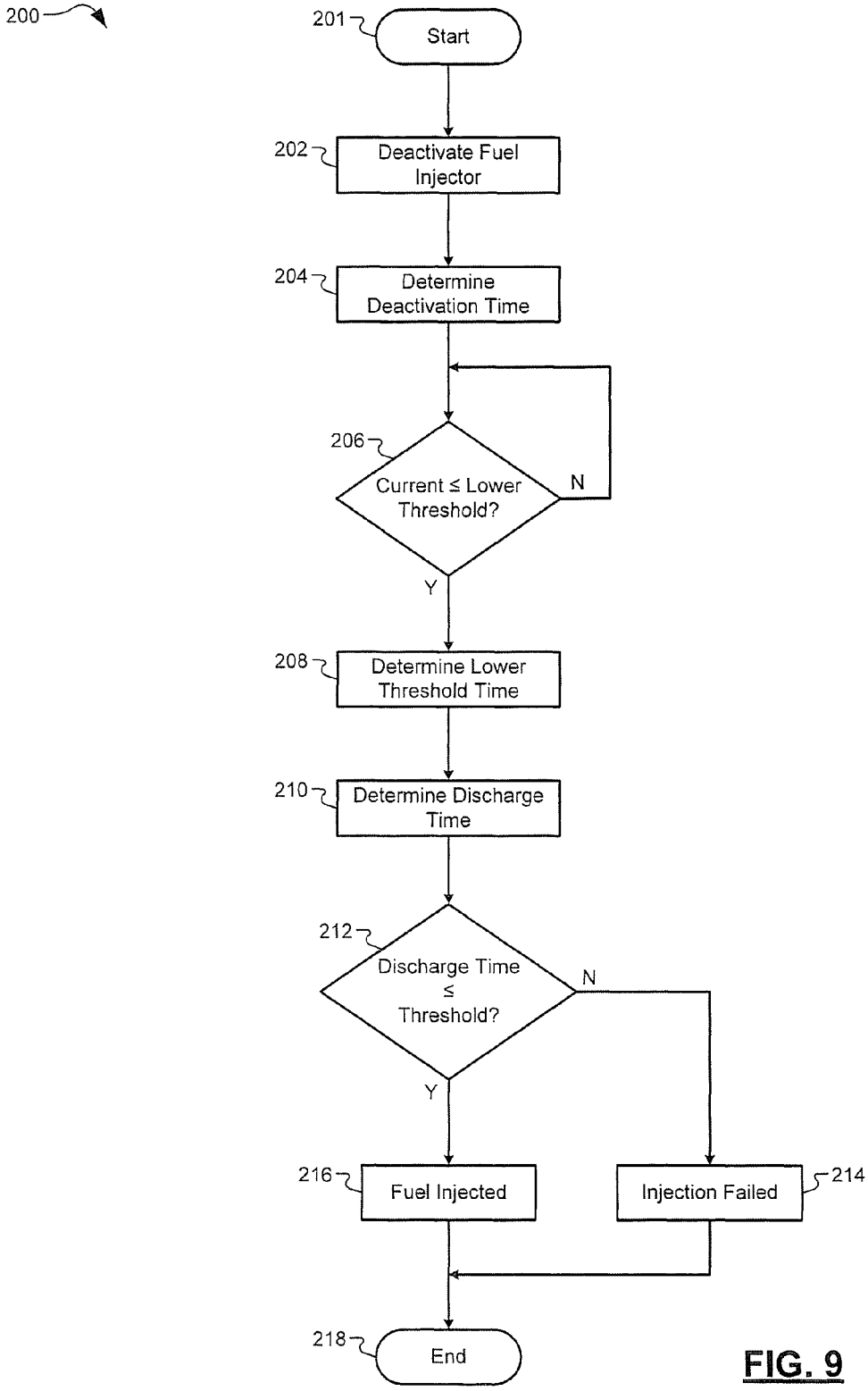
FIG. 9 illustrates a first method for determining position of a fuel injector needle according to the present disclosure.

Referring now to FIG. 9, a first method 200 for determining position of a fuel injector needle begins in step 201. In step 202, the injector control module 180 deactivates the fuel injector 112. In step 204, the injector control module 180 determines the deactivation time. In step 206, the current detection module 182 determines whether the amount of current through the solenoid 162 is less than or equal to the lower threshold. If the result of step 206 is false, the method 200 repeats step 206. If the result of step 206 is true, the method 200 continues with step 208. In step 208, the current detection module 182 determines the lower threshold time. In step 210, the current detection module 182 determines the discharge time based on the deactivation time and the lower threshold time.

In step 212, the position determination module 184 determines whether the discharge time is less than or equal to the predetermined threshold. If the result of step 212 is false, the method 200 continues with step 214. If the result of step 212 is true, the method 200 continues with step 216. In step 214, the position determination module 184 determines that the fuel injector 112 failed to inject fuel. In step 216, the position determination module 184 determines that the fuel injector 112 injected fuel. The method 200 ends in step 218.

Figure 10:
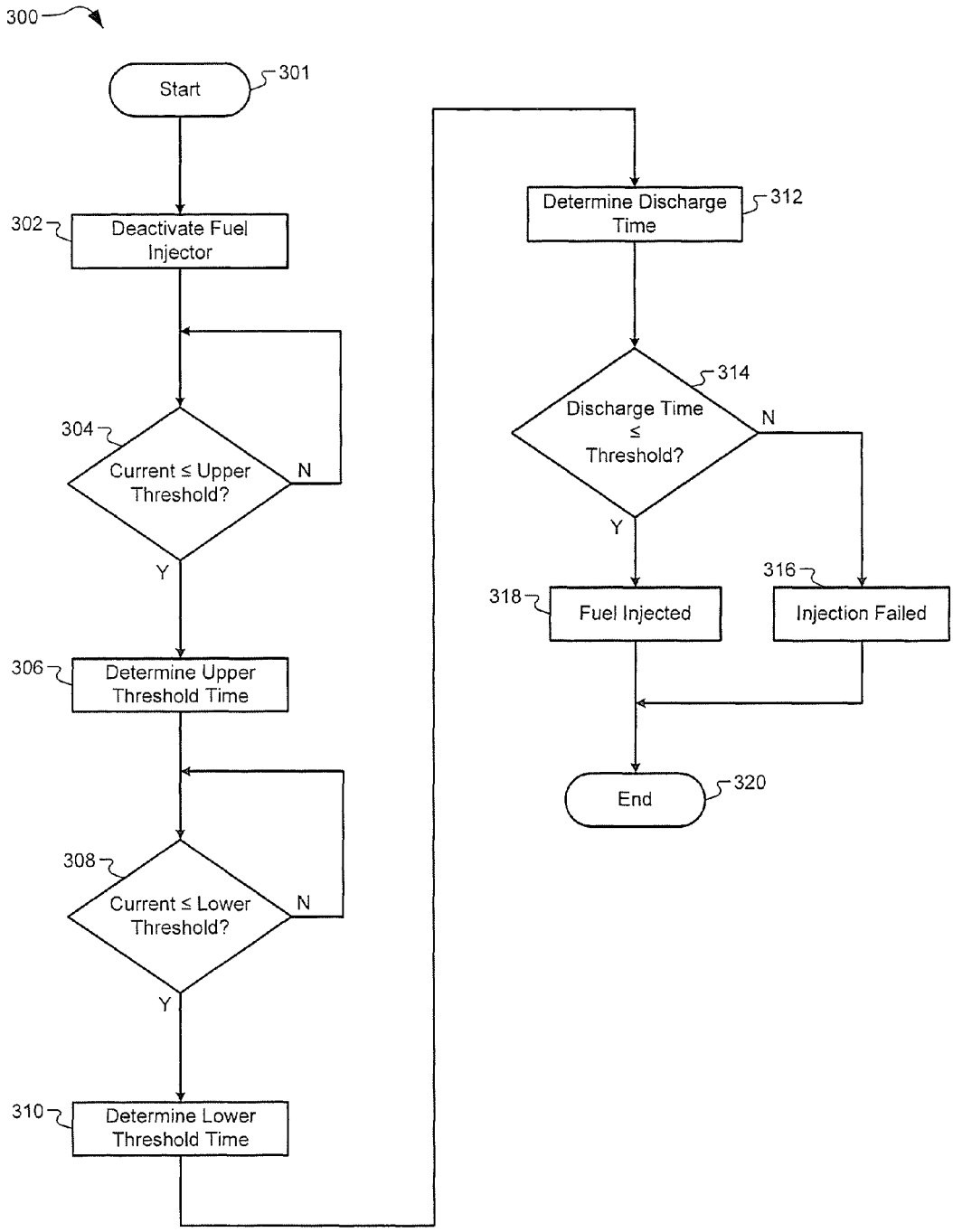
FIG. 10 illustrates a second method for determining position of a fuel injector needle according to the present disclosure.

Referring now to FIG. 10, a second method 300 for determining position of a fuel injector needle begins in step 301. In step 302, the injector control module 180 deactivates the fuel injector 112. In step 304, the current detection module 182 determines whether the amount of current through the solenoid 162 is less than or equal to the upper threshold. If the result of step 304 is false, the method 300 repeats step 304. If the result of step 304 is true, the method 300 continues with step 306. In step 306, the current detection module 182 determines the upper threshold time. In step 308, the current detection module 182 determines whether the amount of current through the solenoid 162 is less than or equal to the lower threshold. If the result of step 308 is false, the method 300 repeats step 308. If the result of step 308 is true, the method 300 continues with step 310. In step 310, the current detection module 182 determines the lower threshold time.

In step 312, the current detection module 182 determines the discharge time based on the upper and lower threshold times. In step 314, the position determination module 184 determines whether the discharge time is less than or equal to the predetermined threshold. If the result of step 314 is false, the method 300 continues with step 316. If the result of step 314 is true, the method 300 continues with step 318. In step 316, the position determination module 184 determines that the fuel injector 112 failed to inject fuel. In step 318, the position determination module 184 determines that the fuel injector 112 injected fuel. The method 300 ends in step 320.

Figure 11:
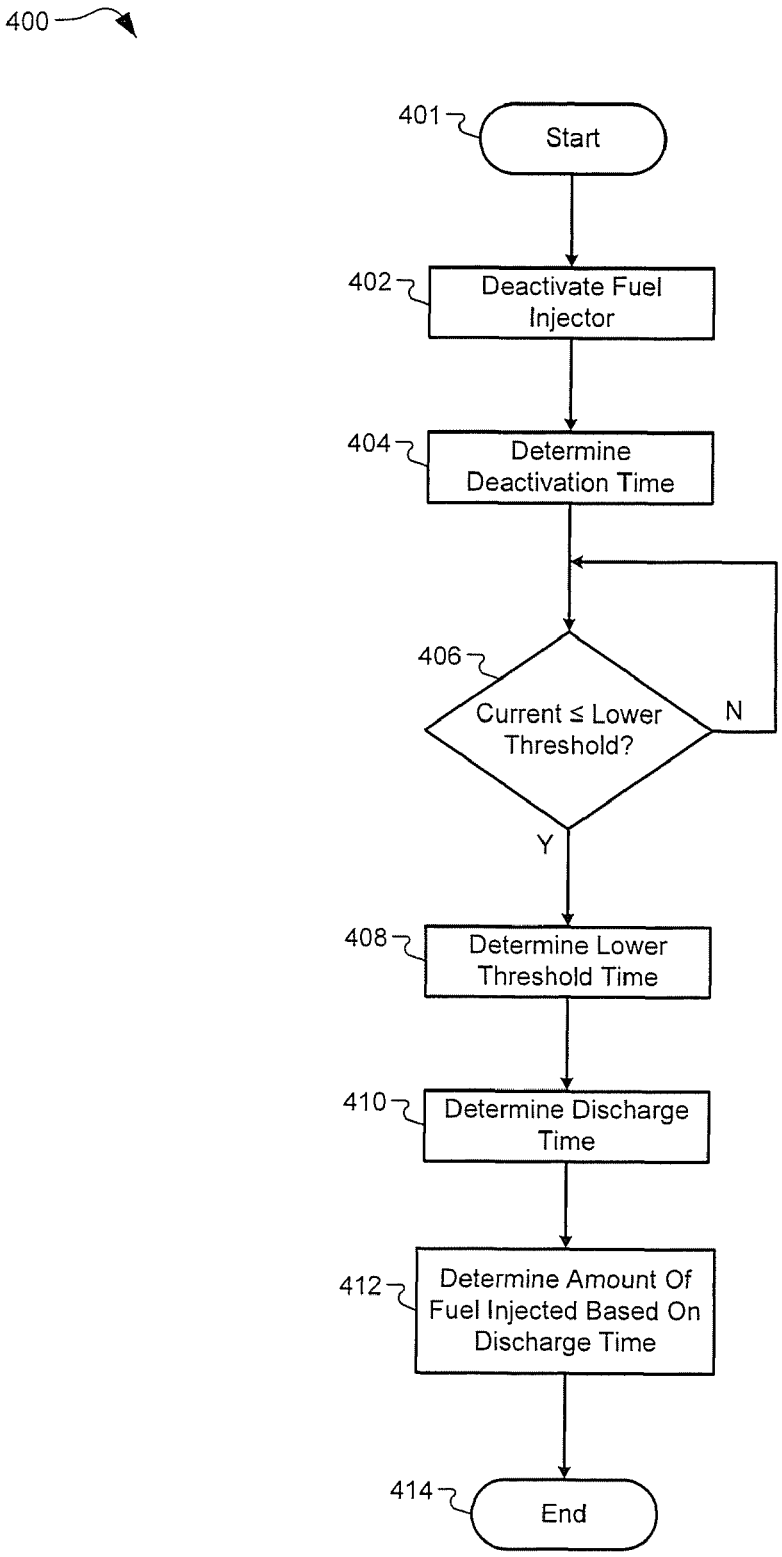
FIG. 11 illustrates a method for determining an amount of fuel injected according to the present disclosure.

Referring now to FIG. 11, a method 400 for determining an amount of fuel injected begins in step 401. In step 402, the injector control module 180 deactivates the fuel injector 112. In step 404, the injector control module 180 determines the deactivation time. In step 406, the current detection module 182 determines whether the amount of current through the solenoid 162 is less than or equal to the lower threshold. If the result of step 406 is false, the method 400 repeats step 406. If the result of step 406 is true, the method 400 continues with step 408. In step 408, the current detection module 182 determines the lower threshold time. In step 410, the current detection module 182 determines the discharge time based on the deactivation time and the lower threshold time. In step 412, the position determination module 184 determines the amount of fuel injected based on the discharge time. The method 400 ends in step 414.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel injection system comprising:

an injector control module that controls current through a solenoid of a fuel injector for a predetermined period;

a current detection module that measures an amount of current through the solenoid after the predetermined period; and a position determination module that determines whether the fuel injector injected fuel during the predetermined period based on when the amount of current through the solenoid is less than or equal to a predetermined current.

2. The fuel injection system of claim 1 wherein the injector control module controls current through the solenoid using a switch, wherein the injector control module closes the switch to connect the solenoid to a power supply that provides current through the solenoid, wherein the injector control module opens the switch to disconnect the solenoid from the power supply, and wherein the solenoid discharges when the switch is open.

3. The fuel injection system of claim 2 wherein the injector control module closes the switch to start the predetermined period, and wherein the injector control module opens the switch to end the predetermined period.

4. The fuel injection system of claim 2 wherein the current detection module measures the amount of current through the solenoid when the solenoid is discharging.

5. The fuel injection system of claim 4 wherein a voltage across the solenoid is held to a predetermined voltage when the solenoid is discharging.

6. The fuel injection system of claim 1 wherein the position determination module determines whether the fuel injector injected fuel based on a length of a period between an end of the predetermined period and when the amount of current through the solenoid is less than or equal to the predetermined current.

7. The fuel injection system of claim 1 wherein the position determination module determines whether the fuel injector injected fuel based on a length of a period between when the amount of current is less than an upper threshold and greater than the predetermined current.

8. The fuel injection system of claim 1 wherein the predetermined period is less than 500 microseconds.

9. The fuel injection system of claim 1 wherein the position determination module determines a position of a needle of the fuel injector at an end of the predetermined period based on when the amount of current through the solenoid is less than or equal to the predetermined current.

10. The fuel injection system of claim 1 wherein the injector control module controls current for the predetermined period to apply a secondary pulse, wherein the secondary pulse is applied after a primary pulse during a cylinder cycle, and wherein the injector control module applies the secondary pulse to inject less than forty percent of an amount of fuel injected during the primary pulse.

11. A method comprising:

controlling current through a solenoid of a fuel injector for a predetermined period;

measuring an amount of current through the solenoid after the predetermined period; and determining whether the fuel injector injected fuel during the predetermined period based on when the amount of current through the solenoid is less than or equal to a predetermined current.

12. The method of claim 11 further comprising:

controlling current through the solenoid using a switch;

closing the switch to connect the solenoid to a power supply that provides current through the solenoid;

opening the switch to disconnect the solenoid from the power supply; and discharging the solenoid when the switch is open.

13. The method of claim 12 further comprising:

closing the switch to start the predetermined period; and opening the switch to end the predetermined period.

14. The method of claim 12 further comprising measuring the amount of current through the solenoid when the solenoid is discharging.

15. The method of claim 14 further comprising holding a voltage across the solenoid to a predetermined voltage when the solenoid is discharging.

16. The method of claim 11 further comprising determining whether the fuel injector injected fuel based on a length of a period between an end of the predetermined period and when the amount of current through the solenoid is less than or equal to the predetermined current.

17. The method of claim 11 further comprising determining whether the fuel injector injected fuel based on a length of a period between when the amount of current is less than an upper threshold and greater than the predetermined current.

18. The method of claim 11 further comprising controlling current through the solenoid for less than 500 microseconds.

19. The method of claim 11 further comprising determining a position of a needle of the fuel injector at an end of the predetermined period based on when the amount of current through the solenoid is less than or equal to the predetermined current.

20. The method of claim 11 further comprising controlling current for the predetermined period to apply a secondary pulse, wherein the secondary pulse is applied after a primary pulse during a cylinder cycle, and wherein the secondary pulse is applied to inject less than forty percent of an amount of fuel injected during the primary pulse.

* * * * *